US008656696B2

(12) United States Patent
Bruch et al.

(10) Patent No.: US 8,656,696 B2
(45) Date of Patent: Feb. 25, 2014

(54) CABLE, GOODS LIFT SYSTEM, AND METHOD OF MAKING THE CABLE

(75) Inventors: Christian Bruch, Gersthofen-Hirblingen (DE); Florian Gojny, Kelkheim (DE)

(73) Assignee: SGL Carbon SE, Wiesbaden (DE)

( * ) Notice: Subject to any disclaimer, the term of this patent is extended or adjusted under 35 U.S.C. 154(b) by 45 days.

(21) Appl. No.: 13/417,504

(22) Filed: Mar. 12, 2012

(65) Prior Publication Data

US 2012/0195733 A1 Aug. 2, 2012

Related U.S. Application Data

(63) Continuation of application No. PCT/EP2010/062405, filed on Aug. 25, 2010.

(30) Foreign Application Priority Data

Sep. 11, 2009 (DE) ..... 10 2009 040 964

(51) Int. Cl.
*D02G 3/36* (2006.01)

(52) U.S. Cl.
USPC ..... 57/232; 57/258

(58) Field of Classification Search
USPC ..... 57/210, 232, 236, 240, 241, 249, 250, 57/258
See application file for complete search history.

(56) References Cited

U.S. PATENT DOCUMENTS

| | | | | |
|---|---|---|---|---|
| 4,044,540 | A | 8/1977 | Toki et al. | |
| 4,272,706 | A | 6/1981 | Somerville | |
| 5,063,261 | A | 11/1991 | Kroker et al. | |
| 2002/0090819 | A1 * | 7/2002 | Xu et al. | 438/690 |
| 2007/0144134 | A1 * | 6/2007 | Kajihara | 57/229 |
| 2010/0133046 | A1 * | 6/2010 | Allwardt et al. | 187/251 |
| 2011/0266097 | A1 | 11/2011 | Valjus et al. | |

FOREIGN PATENT DOCUMENTS

| | | | | |
|---|---|---|---|---|
| DE | 38 13 338 | A1 | 11/1989 | |
| DE | 39 13 145 | A1 | 10/1990 | |
| GB | 2 053 303 | A | 2/1981 | |
| WO | WO 2008110241 | A2 * | 9/2008 | B66B 11/00 |
| WO | 2009/090299 | A1 | 7/2009 | |

OTHER PUBLICATIONS

International Search Report of PCT/EP2010/062405, Dated March 9, 2011.

* cited by examiner

*Primary Examiner* — Shaun R Hurley
(74) *Attorney, Agent, or Firm* — Laurence A. Greenberg; Werner H. Stemer; Ralph E. Locher

(57) ABSTRACT

A cable contains filaments containing carbon, surrounded by a sizing. The filaments surrounded by the sizing are covered by a matrix which is composed of a material containing at least one elastomer and/or at least one thermoplastic elastomer. The cable can be used, in particular for pulling a load, for example in a goods lift.

31 Claims, 2 Drawing Sheets

CABLE, GOODS LIFT SYSTEM, AND METHOD OF MAKING THE CABLE

CROSS-REFERENCE TO RELATED APPLICATION

This is a continuation application, under 35 U.S.C. §120, of co-pending international application No. PCT/EP2010/062405, filed Aug. 25, 2010, which designated the United States; this application also claims the priority, under 35 U.S.C. §119, of German patent application No. DE 10 2009 040 964.5, filed Sep. 11, 2009; the prior applications are herewith incorporated by reference in their entirety.

BACKGROUND OF THE INVENTION

Field of the Invention

The present invention relates to a cable, in particular for use in a load application, such as for example, for use in a traction lift, which contains carbon-containing filaments surrounded by a matrix of polymer material, and a goods lift system having such a cable and a method for manufacturing such a cable.

It is known to provide carbon-containing filaments in cables to increase the tensile strength and to embed these in a matrix of polymer material.

However, the known cables containing carbon-based filaments have a relatively low wear resistance and a corresponding short lifetime. The comparatively low wear resistance of these cables is particularly caused by the fact that during a loading of the cable the individual filaments move relative to one another and rub against one another, whereby damage such as, for example, cracks can occur on the peripheral surface of the fibers, which can reduce the tensile strength of the individual filaments or even result in tearing of individual filaments.

Furthermore, the known cables of the preceding type have the disadvantage that they have a comparatively low flexibility transverse to the longitudinal direction of the cable and consequently a low bendability. When used in a goods lift, for example, in which these cables are guided over one or more deflecting rollers, these cables therefore undergo increased wear if they are not guided over the deflecting roller(s) with a relatively large radius of curvature.

SUMMARY OF THE INVENTION

Against this background, it is the object of the present invention to provide a cable, a goods lift system and a method of making the cable which is characterized by an improved stability, by a better wear resistance, by an increased lifetime and an increased flexibility and to provide a goods lift system having such a cable and a method for manufacturing such a cable.

According to the invention, the object is solved by a cable which contains carbon-containing filaments which are each surrounded by a sizing, where the filaments surrounded by the sizing are covered by a matrix, where the matrix is composed of a material containing at least one elastomer and/or at least one thermoplastic elastomer.

Since the carbon-based filaments according to the invention are each surrounded by a sizing, it is ensured that the individual filaments adhere firmly and permanently to the matrix material surrounding them. Consequently the sheathings of the individual filaments made of sizing act as adhesion promoters between the respective filament and the matrix surrounding this. The matrix thereby separates the individual filaments each surrounded by the sizing from one another. Since the matrix is composed of a material containing at least one elastomer and/or at least one thermoplastic elastomer, this is elastic and can absorb some stresses in the cable. It is thereby ensured that the individual filaments in the cable, even when a large tensile force acts on the cable as a result of application of a load, can move relative to one another without the individual filaments coming in direct contact and consequently rubbing against one another. Consequently the cable has a high and permanent wear resistance. This applies in particular when the cable with applied load is guided over a deflecting device such as, for example, a deflecting roller. In this case, large relative movements of the filaments present in the side of the cable abutting against the deflecting roller necessarily occur with respect to the filaments located further outside in the cable. For the aforesaid reasons, as a result of the elastic properties of the matrix surrounding the filaments and as a result of the firm adhesion of the filaments to the matrix material due to the sheathing made of sizing, abrasion of the individual filaments leading to wear is reliably avoided in this case. As a result, the cable according to the invention is characterized by an increased flexibility and an increased bendability which is why this can, for example, abut uniformly against deflecting rollers having comparatively small radius without being damaged under loading.

In principle, any material can be used as sizing which ensures good adhesion of carbon-based filaments to an elastomer or a thermoplastic elastomer, i.e. which exhibits both a good adhesion to carbon-based filaments and also a good adhesion to elastomers or thermoplastic elastomers. Good results are obtained in particular if the sizing contains at least one material selected from the group consisting of polyurethanes, thermoplastic elastomers, polyesters, rubbers, rubber derivatives and any combinations of two or more of the preceding compounds. The sizing preferably is formed from one of the preceding materials.

In principle, any elastomer and/or thermoplastic elastomer can be used as matrix material. Particularly suitable examples for elastomers include materials selected from the group consisting of ethylene propylene diene rubbers, chloroprene rubbers, chlorosulfonyl polyethlene rubbers, ethylene vinyl acetate rubbers, butyl rubbers, acrylonitrile butadiene rubbers, natural rubber, styrene butadiene rubbers, acrylic rubbers, fluororubbers, silicone rubbers, polyolefin rubbers and any combinations of two or more of the aforesaid compounds where the matrix preferably is formed from one or more of the preceding materials. These materials exhibit good elasticity properties and can additionally adhere firmly and permanently to carbon-based filaments following adhesion by sizing.

Suitable examples for thermoplastic elastomers to be used in the matrix include materials selected from the group consisting of styrene block copolymers, styrene diene block copolymers, mixtures of ethylene propylene diene rubbers as well as polypropylene, urethane-based thermoplastic elastomers, copolyester-based thermolastic elastomers, copolyamide-based thermoplastic elastomers and any combinations of two or more of the aforesaid compounds, where the matrix preferably is formed from one or more of the preceding materials. These materials also exhibit good elasticity properties and can additionally adhere firmly and permanently to carbon-based filaments following adhesion by sizing.

As stated, for example, thermoplastic elastomers can be used both as a matrix material and as a sizing material. According to the invention, however the sizing and the matrix are composed of two different materials, that is in the case of thermoplastic elastomers, of two different thermoplastic elastomers.

In order to achieve a particularly high wear resistance of the cable, as a further development of the invention it is proposed that at least 50%, preferably at least 80%, particularly preferably at least 90% and quite particularly preferably 100% of the filaments surrounded by the sizing are each completely covered by the matrix material. As a result, the individual filaments are completely separated from one another by the matrix material over their entire peripheral area and their entire length so that abrasion of the individual filaments is reliably prevented over their entire area. Completely covered means in this context that the outer peripheral area of each filament coated with sizing is at least 80%, preferably at least 90%, particularly preferably at least 95%, quite particularly preferably at least 98% and most preferably 100% covered by matrix material.

It is further preferred that the individual filaments in the matrix material, relative to the cross-section of the cable, are distributed at least approximately uniformly so that the individual filaments are each covered with at least approximately the same amount of matrix material.

According to a further preferred embodiment of the present invention, the filaments surrounded by the sizing in each case consist of at least 93 wt. %, preferably at least 95 wt. %, particularly preferably at least 98 wt. % and quite particularly preferably completely of carbon. Such filaments have a particularly high tensile strength.

In addition to the carbon-based filaments, the cable can contain fibers of other materials such as, for example, those selected from the group consisting of glass fibers, aramid fibers, metal fibers, ceramic fibers and any combinations of two or more of the preceding fiber types. However, in this case it is preferred that at least 50% of the fibers covered by the matrix are carbon fibers.

As a further development of the inventive idea, it is proposed that at least 50% of the filaments surrounded by the sizing extend along the longitudinal direction of the cable where the maximum deviation of the individual filaments from the longitudinal axis of the cable is preferably a maximum of 15° maximum, more preferably a maximum of 10°, even more preferably a maximum of 5°, particularly preferably a maximum of 2° and most preferably 0°. It is thereby achieved that the filaments exhibit their maximum tensile strength without appreciable transverse forces acting on the individual fibers, with the result that the tensile strength and robustness of the cable is increased. Particularly preferably at least 80%, even more preferably at least 90% and most preferably all the filaments exhibit such an alignment.

According to a further preferred embodiment of the present invention, it is provided that the filaments surrounded by the sizing each extend over at least half the length of the cable, preferably over at least 75% of the length of the cable, particularly preferably over at least 90% of the length of the cable and most preferably over the entire length of the cable. In order to achieve this, the individual filaments can be several decimeters to several meters long.

Individual filaments of the cable according to the invention can be twisted with one another, which is particularly preferred when during their use, the cables are guided over deflecting devices such as, for example, deflecting rollers. In particular, in cables which are not guided over deflecting devices during their use, the individual filaments can also be untwisted.

According to a further preferred embodiment of the present invention, it is provided that the cable has a flat cross-section. Flat cross-section is understood in the sense of the present invention to mean that the cable has an aspect ratio of greater than 1. Aspect ratio designates in this connection the quotient of the maximum cross-sectional extension of the cable to the maximum extension of the cable cross-section in a direction perpendicular to the direction of maximum cross-sectional extension. Due to the flat cross-section, the bendability of the cable is further increased in the height direction. Particularly good results are achieved in this respect if the aspect ratio is greater than 2 and particularly preferably greater than 4.

In order to facilitate the laying of the cable on a deflecting device, for example, on a deflecting roller, it is further preferred that the cross-section of the cable is convex. For example, the cable can have a flat side with a smooth surface, which is convexly curved and has no right-angled or acute-angled edges and which preferably extends at least approximately over the entire width of the cable.

In addition, the cable can have round edges running in the longitudinal direction of the cable and/or one or more guide groove(s) running in the longitudinal direction of the cable. Such a guide groove can be located, for example, at the edge of a surface as described above and be configured for fixing the cable on a correspondingly configured deflecting roller.

In further development of the inventive idea it is proposed that the filaments surrounded by the sizing are configured as a fabric. In this case, a warp fraction of the fabric is preferably higher than its weft fraction.

According to a further preferred embodiment of the present invention, the cable, relative to its cross-section, contains a plurality of superposed layers, wherein each layer contains a plurality of carbon-containing filaments. In this embodiment it is preferred that the individual layers have different elasticities, where the elasticities of the individual layers particularly preferably increase successively from one side of the cable to the opposite side of the cable. When using such a cable with a deflecting device such as, for example, a deflecting roller, the side of the cable with which the cable rests on the deflecting device preferably has a lower elasticity than the opposite side of the cable. As a result, a good bendability of the cable in the direction of the deflection and a close abutment of the cable against the deflecting device is achieved at the same time with high tensile strength and stability of the cable. Such a variation of the elasticity can be achieved, for example, whereby in the individual layers a respectively different number of filaments per cross-sectional area and/or in the individual layers filaments having different thickness or conditions is/are provided.

In order to protect the cable from external mechanical influences, the cable according to the invention can have a sheathing enclosing the matrix, which preferably contains a plastic and at least one additive which is preferably a metal, or consists thereof.

In addition, the cable can have an edge protection which preferably contains a fabric made of metal.

A further subject matter of the invention is a goods lift system which contains the previously described cable. The goods lift system can in particular contain a traction lift, where the cable can be connected at one end to a load, for example, a lift cabin.

According to a preferred embodiment of the present invention, the goods lift system contains at least one deflecting device over which the cable is guided. In this case, the at least one deflecting device can, for example, be a deflecting roller.

In particular, in the preceding embodiment the cable preferably has a flat side and rests with the flat side on the surface of the deflecting device.

In the preceding embodiment it is additionally preferred that the cable, relative to the cross-section contains at least two superposed layers each of different elasticity, wherein the layer facing away from the deflecting device has a higher elasticity than the layer facing the deflecting device. By this measure, as mentioned previously, a good bendability of the cable in the direction of the deflection and a close abutment of the cable against the deflecting device is achieved at the same time with high tensile strength and stability of the cable.

A further subject matter of the invention is the use of a previously described cable or a described load system for pulling a load.

During use, the individual filaments of the cable can be untwisted, which is particularly preferred when the load is pulled with the cable without the cable being deflected between the load and the end opposite to this.

If the cable during its use is guided over at least one deflecting device, for example over at least one deflecting roller, it is on the other hand preferable that the individual filaments of the cable are twisted with one another.

A further subject matter of the present invention is a method for manufacturing the previously described cable, in which at least two carbon-containing filaments are each surrounded by a sizing and the filaments surrounded by the sizing are then impregnated with at least one elastomer and/or at least one matrix material containing a thermoplastic elastomer.

Preferably before application of the sizing and/or before impregnation, the filaments are present as loose filaments or filament bundles (rovings) so that the impregnation can penetrate particularly easily into the region between the filaments surrounded by the sizing. To this end, before application of the sizing and/or before impregnation, the filaments can be dried and/or hardened. To this end, for example, one or more roving(s) can be drawn through a bath of sizing material, the filaments thus treated are then optionally dried and then impregnated with the matrix material, for example, by pultrusion.

Other features which are considered as characteristic for the invention are set forth in the appended claims.

Although the invention is illustrated and described herein as embodied in a cable, a goods lift system and a method of making the cable, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE INVENTION

DETAILED DESCRIPTION OF THE INVENTION

Figure 1:
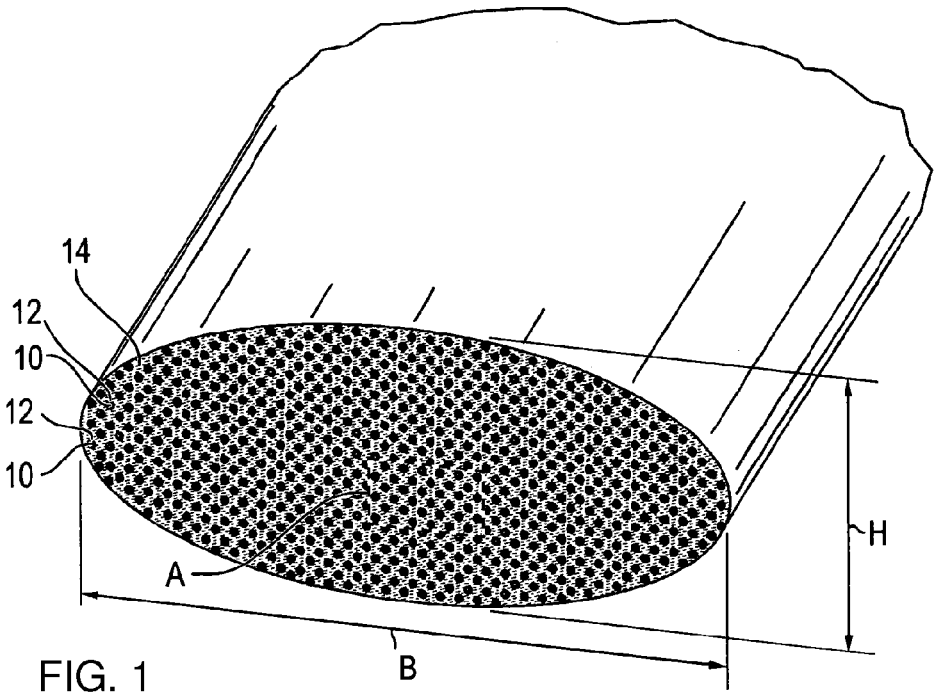
FIG. 1 is a diagrammatic, perspective, partially cutaway view of a cable according to a first exemplary embodiment of the invention.

Referring now to the figures of the drawing in detail and first, particularly, to FIG. 1 thereof, there is shown a cable according to the invention according to a first exemplary embodiment. The cable contains a plurality of carbon-containing filaments 10 which are each surrounded by a sizing 12, where the filaments 10 surrounded by the sizing 12 are covered by a matrix 14 which is composed of a material containing at least one elastomer and/or at least one thermoplastic elastomer. The filaments 10 contain filaments consisting of 100% carbon.

The cable has a convex cross-section and an aspect ratio which corresponds to the quotient of the width B and the height H, of greater than 1.

Figure 2:
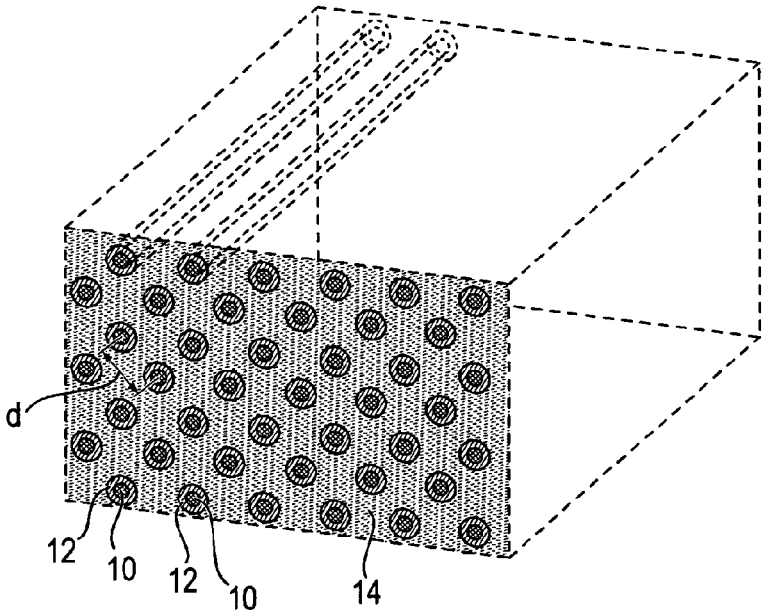
FIG. 2 is an enlarged, perspective view of section A of the cable shown in FIG. 1.

FIG. 2 shows an enlargement of the section A of the cross-section of the cable shown in FIG. 1. For the purpose of illustration the extension in the longitudinal direction of the cable is only shown for two of the filaments 10 surrounded by the sizing 12.

As shown in FIG. 2, the filaments 10 run at least approximately parallel to one another in the longitudinal direction of the cable, where the individual filaments 10 are separated from one another by the matrix 14 and are each completely covered by matrix material 14. In this case, the filaments 10 are distributed relatively uniformly in the matrix 14 so that the distance d between individual filaments 10 and their nearest neighboring filaments 10 is at least approximately the same for all the filaments 10. Due to the filaments 10 being covered by the matrix 14 and the good adhesion of the matrix material 14 on the filaments 10 effected by the sizing 12, mutual friction of the individual filaments 10 among one another is prevented and at the same time, due to the elastic deformability of the matrix 14, a relative mobility of the individual filaments 10 with respect to one another is ensured, whereby overall a high and permanent wear resistance of the cable is achieved.

Figure 3:
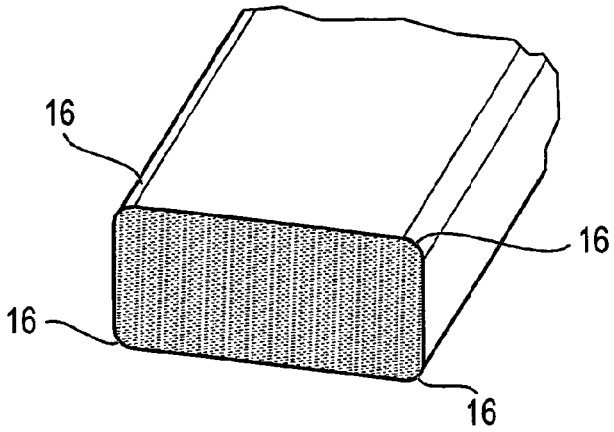
FIG. 3 is a diagrammatic, perspective, partially cutaway view of the cable according to a second exemplary embodiment of the invention.

FIG. 3 shows a partially cutaway view of a cable according to the invention according to a second exemplary embodiment, which has rectangular cross-section, where the individual corners are rounded to form four round edges 16.

Figure 4:
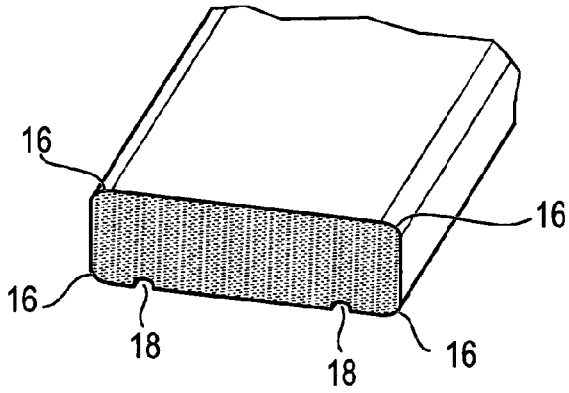
FIG. 4 is a diagrammatic, perspective, partially cutaway view of the cable according to a third exemplary embodiment of the invention.

FIG. 4 shows a partially cutaway view of a cable according to the invention according to a third exemplary embodiment, which has two guide grooves 18. With the guide grooves 18 the cable can engage in a precisely fitting manner in a guiding or deflecting device.

Figure 5:
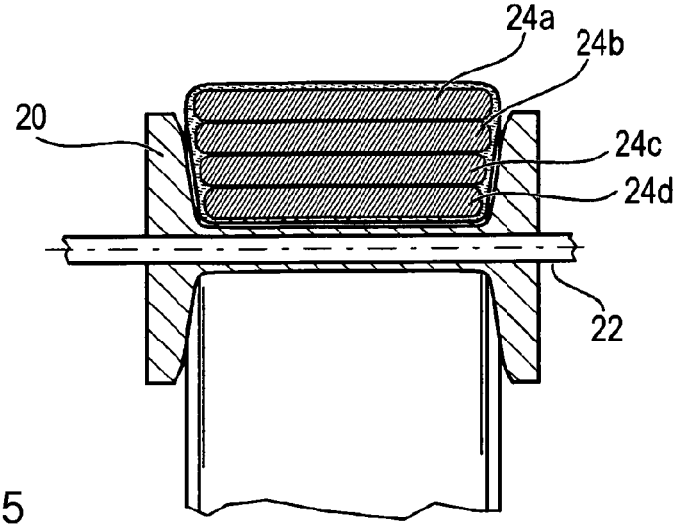
FIG. 5 is a diagrammatic, sectional view of the cable according to a fourth exemplary embodiment of the invention.

FIG. 5 shows a sectional view of a cable according to the invention according to a fourth exemplary embodiment, which is guided over a deflecting roller 20 mounted on an axis 22. In relation to its cross-section the cable has a plurality of superposed layers 24*a-d* where each layer 24*a-d* contains a plurality of carbon-containing filaments 10. The layers 24*a-d* have different elasticities, where the elasticity decreases stepwise from the layer 24*a* which is situated on the side of the cable facing away from the deflecting roller 20, to the layer 24*d* which is situated on the side of the cable facing the deflecting roller 20.

The invention claimed is:

1. A cable, comprising:

carbon-containing filaments;

a sizing surrounding said filaments, said sizing containing at least one material selected from the group consisting of polyurethanes, thermoplastic elastomers, polyesters, rubbers, rubber derivatives and any combination of at least two of the preceding compounds;

a matrix covering said filaments surrounded by said sizing, said matrix composed of a material containing at least one of an elastomer or at least one thermoplastic elastomer;

individual ones of said filaments surrounded by said sizing are untwisted with one another;

at least 50% of said filaments surrounded by said matrix are carbon fibers; and a sheathing enclosing said matrix.

2. The cable according to claim 1, wherein said at least one elastomer is selected from the group consisting of ethylene propylene diene rubbers, chloroprene rubbers, chlorosulfonyl polyethylene rubbers, ethylene vinyl acetate rubbers, butyl rubbers, acrylonitrile butadiene rubbers, natural rubber, styrene butadiene rubbers, acrylic rubbers, fluororubbers, silicone rubbers, polyolefin rubbers and any combination of at least two of the aforesaid compounds.

3. The cable according to claim 1, wherein said at least one thermoplastic elastomer is selected from the group consisting of styrene block copolymers, styrene diene block copolymers, mixtures of ethylene propylene diene rubbers as well as polypropylene, urethane-based thermoplastic elastomers, copolyester-based thermoplastic elastomers, copolyamide-based thermoplastic elastomers and any combinations of at least two of the aforesaid compounds.

4. The cable according to claim 1, wherein at least 50% of said filaments surrounded by said sizing are each completely covered by said matrix.

5. The cable according to claim 1, wherein said filaments surrounded by said sizing in each case consist of at least 93 wt. % of carbon.

6. The cable according to claim 1, wherein at least some of said filaments are selected from the group consisting of glass fibers, aramid fibers, metal fibers, ceramic fibers and any combinations of at least two of the preceding fibers.

7. The cable according to claim 1, wherein at least 50% of said filaments surrounded by said sizing extend along a longitudinal direction of the cable with a maximum deviation from said longitudinal direction of 15° maximum.

8. The cable according to claim 1, wherein the cable has a flat cross-section and an aspect ratio of the cable is greater than 1.

9. The cable according to claim 1, wherein said carbon-containing filaments, said sizing and said matrix together define a cable body, said cable body having round edges running in a longitudinal direction of the cable and at least one guide groove formed in said cable body and running in the longitudinal direction of the cable.

10. The cable according to claim 1, wherein said filaments surrounded by said sizing are configured as a fabric.

11. The cable according to claim 10, wherein a warp fraction of said fabric is higher than a weft fraction of said fabric.

12. The cable according to claim 1, wherein the cable, relative to a cross-section, further comprising a plurality of superposed layers, wherein each of said layers has a plurality of said carbon-containing filaments.

13. The cable according to claim 12, wherein individual ones of said superposed layers have different elasticities.

14. The cable according to claim 13, wherein said elasticities of individual ones of said superposed layers increase successively from one side of the cable to an opposite side of the cable.

15. The cable according to claim 1, wherein said sheathing contains a plastic and at least one additive.

16. The cable according to claim 1, further comprising an edge protection containing a fabric made of metal.

17. The cable according to claim 1, wherein at least 80% of said filaments surrounded by said sizing are each completely covered by said matrix.

18. The cable according to claim 1, wherein said filaments surrounded by said sizing in each case consist of at least 95 wt. % of carbon.

19. The cable according to claim 1, wherein the cable has a flat cross-section and an aspect ratio of the cable is greater than 2.

20. The cable according to claim 15, wherein said additive is a metal.

21. The cable according to claim 1, wherein the cable is configured to be used in a traction lift.

22. A goods lift system, comprising:

a cable containing carbon-containing filaments, a sizing surrounding said filaments, and a matrix covering said filaments surrounded by said sizing, said matrix is composed of a material containing at least one of an elastomer or at least one thermoplastic elastomer;

said sizing containing at least one material selected from the group consisting of polyurethanes, thermoplastic elastomers, polyesters, rubbers, rubber derivatives and any combination of at least two of the preceding compounds;

individual ones of said filaments surrounded by said sizing are untwisted with one another;

at least 50% of said filaments surrounded by said matrix are carbon fibers; and a sheathing enclosing said matrix.

23. The goods lift system according to claim 22, further comprising at least one deflecting device over which said cable is guided.

24. The goods lift system according to claim 23, wherein said at least one deflecting device is at least one deflecting roller.

25. The goods lift system according to claim 23, wherein said cable has a flat side and rests with said flat side on a surface of said deflecting device.

26. The goods lift system according to claim 23, wherein said cable, relative to a cross-section contains at least two superposed layers each of different elasticity, wherein said superposed layer facing away from said deflecting device has a higher elasticity than said superposed layer facing said deflecting device.

27. The goods lift system according to claim 22, wherein the goods lift system is a traction lift.

28. A method for pulling a load, which comprises the steps of:

providing a cable containing carbon-containing filaments, a sizing surrounding the filaments, a matrix covering the filaments surrounded by the sizing, and a sheathing enclosing the matrix, the matrix is composed of a material containing at least one of an elastomer or at least one thermoplastic elastomer, the individual filaments of the cable are untwisted, the sizing containing at least one material selected from the group consisting of polyurethanes, thermoplastic elastomers, polyesters, rubbers, rubber derivatives and any combination of at least two of the preceding compounds, at least 50% of the filaments surrounded by the matrix are carbon fibers; and using the cable for pulling the load.

29. A method for pulling a load, which comprises the steps of:

providing a cable containing carbon-containing filaments, a sizing surrounding the filaments, a matrix covering the filaments surrounded by the sizing, and a sheathing enclosing the matrix, the matrix is composed of a material containing at least one of an elastomer or at least one thermoplastic elastomer, and the filaments of the cable are untwisted with one another, the sizing containing at least one material selected from the group consisting of polyurethanes, thermoplastic elastomers, polyesters, rubbers, rubber derivatives and any combination of at least two of the preceding compounds, at least 50% of the filaments surrounded by the matrix are carbon fibers; and using the cable for pulling the load by guiding the cable over at least one deflecting device.

30. The method for pulling the load according to claim 29, which further comprises using at least one deflecting roller as the at least one deflecting device.

31. A method for manufacturing a cable, which comprises the steps:

surrounding each of at least two carbon-containing filaments with a sizing, the sizing containing at least one material selected from the group consisting of polyurethanes, thermoplastic elastomers, polyesters, rubbers, rubber derivatives and any combination of at least two of the preceding compounds, individual ones of the filaments surrounded by the sizing are untwisted with one another;

impregnating the carbon-containing filaments surrounded by the sizing with at least one of an elastomer or at least one matrix material containing a thermoplastic elastomer, at least 50% of the filaments surrounded by the matrix are carbon fibers; and enclosing the matrix or the elastomer with a sheathing.

* * * * *